United States Patent [19]

Burnop et al.

[11] 3,965,017

[45] June 22, 1976

[54] LUBRICATING OIL COMPOSITIONS

[75] Inventors: Victor Charles Ernest Burnop; Ronald Charles Watkins, both of Wantage, England

[73] Assignee: Exxon Research and Engineering Company, Linden, N.J.

[22] Filed: May 12, 1975

[21] Appl. No.: 576,968

[30] Foreign Application Priority Data

May 17, 1974 United Kingdom ..... 22085/74

[52] U.S. Cl. ..... 252/33.3; 252/33.4; 252/40.7; 252/42.7; 252/52 A

[51] Int. Cl.[2] ..... C10M 1/40; C10M 3/34; C10M 1/54; C10M 3/48

[58] Field of Search ..... 252/33.3, 33.4, 42.7, 252/40.7, 52 A

[56] References Cited

UNITED STATES PATENTS

| | | | |
|---|---|---|---|
| 3,082,168 | 3/1963 | Rue et al. | 252/33.3 |
| 3,714,042 | 1/1973 | Greenough | 252/33.4 |
| 3,853,774 | 12/1974 | Crocker | 252/33.4 |

*Primary Examiner*—Delbert E. Gantz
*Assistant Examiner*—I. Vaughn

[57] ABSTRACT

A lubricating oil composition comprising a lubricating oil base and (A) an overbased detergent additive (e.g. an organic phenate) is foam stabilised by adding thereto, (B) 0.1 to 15 wt.% based on the weight of (A) of a monocarboxylic acid, anhydride or salt thereof, or a dicarboxylic acid, anhydride or salt thereof, said acid, anhydride (e.g. a polyisobutenyl succinic anhydride) or salt having at least 30 carbon atoms per molecule or the reaction product of a phosphorus sulphide with a hydrocarbon and (C) a dihydric alcohol having 2,3, or 4 carbon atoms per molecule (e.g. ethylene glycol), or a di- or tri- ($C_2$–$C_4$) glycol or an ether alcohol having 2 to 10 carbon atoms per molecule.

17 Claims, No Drawings

LUBRICATING OIL COMPOSITIONS

This invention relates to lubricating oil compositions containing detergent additives which have high basicity, commonly known as overbased additives.

Many lubricating oil compositions containing overbased additives suffer from lack of stability giving rise to sedimentation. Also such compositions when used in a crankcase have troublesome foaming problems. We have now found that by adding at least two additives ((B) and (C)) to such lubricating oil compositions said foaming tendency is at least minimised, if not eliminated, and the tendency to sedimentation reduced.

According to this invention foam stabilised lubricating oil compositions comprise a lubricating oil, (A) an overbased detergent additive, (B) 0.1 to 15 wt.% based on the weight of (A) of a monocarboxylic acid, anhydride or salt thereof or a dicarboxylic acid, anhydride or a salt thereof, said acid, anhydride or salt having at least 30 carbon atoms per molecule or a reaction product of a phosphorus sulphide with a hydrocarbon and (C) a dihydric alcohol having 2,3 or 4 carbon atoms per molecule or a di-or tri- ($C_2$–$C_4$) glycol or an ether alcohol having 2 to 10 carbon atoms per molecule.

According to this invention foam stabilised lubricating oil compositions are prepared by a process in which to a lubricating oil composition comprising a lubricating oil and (A) an overbased detergent additive is added (B) 0.1 to 15 wt.% based on the weight of (A) of a monocarboxylic acid, anhydride or salt thereof or a dicarboxylic acid, anhydride or a salt thereof, said acid, anhydride or salt having at least 30 carbon atoms per molecule, or the reaction product of a phosphorus sulphide with a hydrocarbon and (C) a dihydric alcohol having 2,3 or 4 carbon atoms per molecule, or a di- or tri- ($C_2$–$C_4$) glycol or an ether alcohol having 2 to 10 carbon atoms per molecule.

The lubricating oil can be any animal, vegetable or mineral oil, for example ranging from petroleum oil to SAE 30, 40, or 50 lubricating oil grades, castor oil, fish oils or oxidised mineral oil.

Alternatively the lubricating oil can be a synthetic ester lubricating oil and these include diesters such a di-octyl adipate, di-octyl sebacate didecyl azelate, tridecyl adipate, didecyl succinate, didecyl glutarate and mixtures thereof. Alternatively the synthetic ester can be a polyester such as that prepared by reacting polyhydric alcohols such as trimethylol propane and pentaerythritol with monocarboxylic acids such as butyric acid to give the corresponding tri- and tetra- esters. Also complex esters may be used, such as those formed by esterification reactions between a carboxylic acid, a glycol and an alcohol or a monocarboxylic acid.

Component (A) of the stabilised lubricating oil composition is an overbased detergent additive by which term we mean a salt or complex wherein the amount of metal cation is in excess of stoicheiometric compared with the oil-soluble anion. Usually this excess is obtained by treating the reaction mixture for the preparation of the additive with an acidic gas such as carbon dioxide or hydrogen sulphide, when the final product contains a colloidal dispersion in oil of the metal salt derived from the metal and acidic gas, e.g. a carbonate, or sulphide.

Particularly suitable overbased detergent additives are overbased organic sulphonates or overbased phenates.

Organic sulphonates can be obtained from the sulphonic acids derived from sulphonating natural hydrocarbons or synthetic hydrocarbons. Such sulphonic acids are obtained by treating lubricating oil base stocks with concentrated or fuming sulphuric acid to produce oil-soluble "mahogany" acids or by sulphonating alkylated aromatic hydrocarbons. Particularly useful are the products derived from the alkylation of aromatic hydrocarbons with olefins or olefin polymers, e.g. $C_{15}$–$C_{30}$ polypropenes or polybutenes.

The sulphonic acids can contain more than one sulphonic acid group in the molecule. The preferred sulphonic acids have molecular weights of from 300 to 1000. The sulphonates are usually the alkaline earth metal sulphonates, usually the calcium or barium sulphonates, but can however be alkali metal sulphonates, e.g. sodium sulphonates.

The overbased sulphonates are high alkalinity sulphonates which contain metal base in excess of that required for simple neutralization of the sulphonic acids to the normal metal sulphonates. In preparing the overbased sulphonates, the sulphonic acids are reacted with an excess of metal base and the excess base is usually neutralised with an acidic gas, e.g. carbon dioxide, preferably in the presence of a promoter e.g. an alkyl phenol or an alcohol such as methanol or propanol. The preferred overbased sulphonates have a TBN (total base number) (ASTM D664) of from 50 to 500, especially 50 to 350. Thus specific examples are overbased synthetic calcium hydrocarbon sulphonates of about 300 TBN with a molecular weight of 400 to 500; barium salts of a petroleum sulphonic acid (MW 500 to 600) overbased to a TBN of 50 to 70; a calcium salt of sulphonated bottoms from a $C_{12}$ alkyl benzene overbased to a TBN of 230 to 270; a zinc salt of a petroleum sulphonic acid of MW 400 to 500 overbased to a TBN of 175 to 225 and a barium $C_{16}$ alkyl benzene sulphonate overbased to a TBN of 280 to 300. A suitable method of making an overbased sulphonate is described in the specification of our U.S. Pat. No. 1,299,253.

Suitable phenates include the alkali metal and alkaline earth metal phenates. The alkyl phenate can be prepared by reacting an alkyl phenol, e.g. octyl, nonyl, n-decyl, cetyl or dioctyl phenol with an alkali metal base or preferably an alkaline earth metal base e.g. barium octahydrate. To make the corresponding overbased phenate, the phenol is reacted with excess base, and the excess neutralised with an acidic gas, e.g. carbon dioxide. Overbased phenates having a TBN of 50 to 100 are very suitable.

Instead of using a phenate one may use the corresponding sulphurised phenate. Such phenates are prepared by reacting the alkyl phenate with elemental sulphur to give a complex reaction product, free alkyl phenol or volatile material in the reaction product preferably being removed by steam distillation.

Other overbased detergent additives include overbased metal salts of long chain mono- or di-carboxylic acids, e.g. those wherein the acid radical contains at least 50 carbon atoms per molecule. Thus one may use for example metal salts, e.g. calcium or barium, of long chain succinic acids, e.g. those having a molecular weight of 850 to 1200. In order to obtain the high alkalinity the metal salt reaction mixture can be treated with carbon dioxide, usually in the presence of a promoter such as alkyl phenol or an alcohol.

Other suitable overbased detergent additives include products prepared by reacting an alkali metal base or an alkaline earth metal base with a phosphosulphurised hydrocarbon and an alkyl phenol or an alkyl phenol sulphide in the presence of a diluent oil, carbon dioxide being blown into the reaction mixture whilst the reaction takes place. As an alternative one can start off with the already prepared alkali metal or alkaline earth metal alkyl phenate or alkyl thiophenate. Methods of preparing such products are described in UK Pat. specification Nos. 921,124, 940,175, 958,520, 970,786, 867,800 and 887,334. The calcium or barium salts are preferred.

Another suitable overbased detergent additive is an overbased alkali metal or alkaline earth metal salicylate, e.g. an overbased calcium salicylate. These may be made by reacting an oil soluble metal salt, e.g. calcium salt, of an alkyl salicyclic acid in the presence of oil and a water-miscible oxygen-containing organic solvent, e.g. an alcohol, glycol or ketone, with a polyvalent metal carbonate which is formed in situ in the reaction mixture. The in situ formation of the polyvalent metal carbonate may be carried out by the reaction of a polyvalent base such as an oxide, hydroxide or alkoxide with carbon dioxide passed into the reaction mixture.

Component (B) of the foam-stabilised lubricating oil composition may be a monocarboxylic acid, anhydride or salt thereof or a dicarboxylic acid, anhydride or salt thereof, said acid, anhydride or salt having at least 30 carbon atoms per molecule. Thus, the acid, anhydride or salt may have a molecular weight of above 500 and preferred acids, anhydrides or salts are those having a molecular weight of between 600 and 3000, e.g. between 800 and 1800. These carboxylic acids, anhydrides or salts are conveniently derived from a polymer of a mono-olefin e.g. a $C_2$ to $C_5$ mono-olefin, such as polyethylene, polypropylene or polyisobutene.

A convenient method of making long-chain monocarboxylic acids is described in the specification of our U.K. Pat. No. 1,075,121. One starts with a halogenated polyolefin, e.g. a halogenated polymer of a $C_2$ to $C_5$ mono-olefin having an average molecular weight of between 600 and 3000. This halogenated polyolefin is condensed with an alpha, beta-unsaturated monocarboxylic acid, e.g. one having between 3 and 8 carbon atoms per molecule, e.g. acrylic acid, $\alpha$-methacrylic acid, crotonic or isocrotonic acid. The condensation reaction is preferably carried out between 150°C and 360°C using stoicheiometric excess of acid.

Di-carboxylic acid anhydrides having a relatively long chain may be conveniently made by the reaction of maleic anhydride with a long-chain olefin or a halogenated long-chain olefin. The preferred olefins are polymers of mono-olefins, especially those described above with reference to making long-chain monocarboxylic acids. Thus one may react a polyisobutene of molecular weight between 600 to 3000 or the halogenated derivative thereof with maleic anhydride to give a polyisobutenyl succinic anhydride. The two reactants may be merely heated together at a temperature of between 150°C and 200°C.

The corresponding acids can be made by hydrolysing the anhydrides. A particular example of a long chain mono-carboxylic acid is polybutenyl propionic acid of MW approximately 1000 whereas a particular example of a long chain dicarboxylic acid is polybutenyl succinic acid of MW approximately 1000.

If desired one can use the salt and suitable salts are the salts of the above mentioned acids and anhydrides. The cation may for example be an alkali metal, e.g. sodium or potassium or an alkaline earth metal, e.g. magnesium, calcium or barium. Conveniently but not essentially, the metal is the same as that of the overbased detergent additive.

As an alternative component (B) can be the reaction product of a phosphorus sulphide with a hydrocarbon. The hydrocarbon which is reacted with the phosphorus sulphide may be for example a paraffinic or olefinic polymer.

The preferred hydrocarbon which is reacted with the phosphorus sulphide is an olefin polymer, especially mono-olefin polymers where the molecular weight ranges from 100 to 50,000 e.g. 250 to 10,000. These polymers may be obtained by polymerizing low molecular weight mono-olefinic hydrocarbons such as propylene, butylene, isobutylene or the hexenes.

Although phosphorus trisulphide can be used it is preferred to react the hydrocarbons with phosphorus pentasulphide. This reaction may take place at about 100°C to 300°C.

Particularly preferred phosphorus sulphide reaction products are those of $P_2S_5$ with a polyolefin having a molecular weight of between 500 and 1500, e.g. about 1000, especially with a polyisobutene, e.g. one having a molecular weight of 800 to 1200.

Component (C) of the foam-stabilised lubricating oil composition may be a dihydric alcohol having 2,3 or 4 carbon atoms, i.e. ethylene glycol, a propylene glycol or a butylene glycol. Alternatively it may be a di- or tri-($C_2$–$C_4$) glycol i.e. diethylene glycol, triethylene glycol, a dipropylene glycol, a tripropylene glycol, a dibutylene glycol, or a tributylene glycol. As a further alternative it may be a $C_2$ to $C_{10}$ ether alcohol. Suitable ether alcohols are monoalkyl ethers of ethylene glycol such as the methyl or ethyl ethers of ethylene glycol. They could equally well be the monoalkyl ethers (e.g. methyl or ethyl) of other glycols such as propylene glycol and butylene glycol. The preferred ether alcohols are the methoxy and ethoxy ethers of ethylene glycol and of diethylene glycol.

The foam stabilised lubricating oil composition may if desired incorporate a fourth component (D) which is an alkyl phenol wherein the or each alkyl group contains 6 to 20 carbon atoms. It is preferred that the alkyl phenol be a monoalkyl phenol, especially a para-monoalkyl phenol. Suitable alkyl groups include hexyl, octyl, nonyl, decyl, dodecyl and heptadecyl. The preferred alkyl phenol is para-nonyl phenol, but other suitable alkyl phenols include ortho decyl phenol and 2,4 didecyl phenol. The addition of the alkyl phenol usually prevents the formation of grease which often occurs on the addition of component (B).

In preparing the foam-stabilised lubricating oil compositions it is usual but not necessary to add components B and C and optionally D to the lubricating oil already containing A. The lubricating oil composition usually contains a minor proportion by weight of component A, preferably 0.01 to 20 wt.%, e.g. 0.1 to 10 wt.%.

Although any amount of components C and D may be added it is preferred in practice to add the following amounts, all quantities being based on the total weight of the active ingredient (i.e. all compounds excluding the oil) in the overbased detergent additive i.e. component A.

B — 0.1 to 10, preferably 1–7 wt.%.
C — 0.01 to 6, preferably 0.1–1 wt.% and if present,
D — 0.1 to 30, preferably 3–15 wt.%

EXAMPLE 1

Various additives were added to a base oil blend comprising a mineral lubricating oil containing 5.0 wt.% of an overbased calcium salicylate together with about 9 wt.% of conventional dispersants and antiwear additives.

From the following table it can be seen that only when the long chain (MW ~ 900) polyisobutenyl succinic anhydride (PIBSA) and ethylene glycol is added is there significant reduction in the sedimentation.

| Treatment (% wt.) | Percent Sedimentation |
|---|---|
| Nil | 4.0 |
| 0.2% ethylene glycol | 1.3 |
| 0.2% diethylene glycol | 1.5 |
| 0.2% triethylene glycol | 3.0 |
| 0.2% of a 90/10 (wt.) mixture of PIBSA and nonyl phenol | 3.0 |
| 0.2% of a 90/10 (wt.) mixture of PIBSA and nonyl phenol and 0.2% ethylene glycol | 0.01 |

EXAMPLE 2

A blend was prepared containing 28 wt.% of an oil solution of overbased (carbonated) calcium sulphurised alkyl phenate having a TBN of about 250 and 72 wt.% of a mineral lubricating oil. The oil solution of phenate (hereinafter referred to as X) itself contained 27 wt.% of oil so that the final blend was about 20.4 wt.% of overbased phenate and 79.6 wt.% of oil. When this blend had cooled, almost immediately a large amount of sedimentation occurred.

Similar blends were then prepared with various additives. In each case the additive or additives were blended with X and the resultant blend added to a mineral lubricating oil so that X plus additive or additives were 28 wt.% and the mineral lubricating oil was 72 wt.%. As can be seen from the following table the composition of this invention has decided advantages

| Additive(s) | Wt.% based on X | Remarks |
|---|---|---|
| PIBSA* | 10 | Hazy after 24hr |
| PIBSA* | 13 | Clear after 24hr |
| Ethylene glycol | 3 | Hazy after 24hr |
| Ethylene glycol** | 4 | Clear after 24hr |
| PIBSA + Ethylene glycol | 6 / 3 | Clear after 24hr |

*long chain polyisobutenyl succinic anhydride (MW ~ 900)
**Adverse effects in the form of water pick-up and emulsion formation

What is claimed is:

1. A foam stabilised lubricating oil composition comprising a lubricating oil base, from 0.01 to 20 wt.% of (A) an overbased detergent additive, (B) 0.1 to 15 wt.% based on the weight of (A) of an aliphatic monocarboxylic acid, anhydride or salt thereof, or an aliphatic dicarboxylic acid, anhydride or salt thereof, said acid, anhydride or salt having at least 30 carbon atoms per molecule or the reaction product of a phosphorus sulphide with a hydrocarbon and (C) a dihydric alcohol having 2,3 or 4 carbon atoms per molecule, or a di- or tri- ($C_2$–$C_4$) glycol or an ether alcohol having 2 to 10 carbon atoms per molecule.

2. A composition according to claim 1 wherein the overbased detergent additive (A) is an overbased organic sulphonate.

3. A composition according to claim 2 wherein the organic sulphonate is derived from an alkylated aromatic hydrocarbon obtained by the alkylation of an aromatic hydrocarbon with an olefin or olefin polymer.

4. A composition according to claim 2 wherein the sulphonate is an alkaline earth metal sulphonate.

5. A composition according to claim 2 wherein the overbased organic sulphonate has a TBN of from 50 to 350.

6. A composition according to claim 1 wherein the overbased detergent additive (A) is an overbased organic phenate.

7. A composition according to claim 6 wherein the overbased phenate has a TBN of from 50 to 100.

8. A composition according to claim 1 wherein the overbased detergent additive is an overbased organic sulphurised phenate.

9. A composition according to claim 1 wherein the carboxylic acid, anhydride of salt (B) has a molecular weight of between 600 and 3000.

10. A composition according to claim 1 wherein the carboxylic acid, anhydride or salt (B) is derived from a polymer of a $C_2$ to $C_5$ mono-olefin.

11. A composition according to claim 10 wherein the anhydride is a polyisobutenyl succinic anhydride.

12. A composition according to claim 1 wherein the reaction product of a phosphorus sulphide with a hydrocarbon is the reaction product of $P_2S_5$ with a polyolefin having a molecular weight of between 500 and 1500.

13. A composition according to claim 1 wherein component (C) is ethylene glycol, diethylene glycol or triethylene glycol.

14. A composition according to claim 1 which also includes (D) an alkyl phenol wherein the or each alkyl group contains 6 to 20 carbon atoms.

15. A composition according to claim 14 wherein the alkyl phenol is a para-monoalkyl phenol.

16. A composition according to claim 1 wherein the amounts of components are 0.1 to 10 wt.% of B, 0.01 to 6 wt.% of C and if present 0.01 to 30 wt.% of D based on the total weight of active ingredient in component A.

17. A composition according to claim 6 wherein the amounts of components are 1 to 7 wt.% of B, 0.1 to 1 wt.% of C and if present 3 to 15 wt.% of D based on the total weight of active ingredient in component A.

* * * * *